US009726191B2

(12) United States Patent
Wang

(10) Patent No.: US 9,726,191 B2
(45) Date of Patent: Aug. 8, 2017

(54) CEILING FAN

(71) Applicant: Air Cool Industrial Co., Ltd., Taichung (TW)

(72) Inventor: Cliff Wang, Taichung (CN)

(73) Assignee: AIR COOL INDUSTRIAL CO., LTD., Taichung (TW)

( * ) Notice: Subject to any disclaimer, the term of this patent is extended or adjusted under 35 U.S.C. 154(b) by 1287 days.

(21) Appl. No.: 13/666,256

(22) Filed: Nov. 1, 2012

(65) Prior Publication Data

US 2014/0119925 A1 May 1, 2014

(51) Int. Cl.

| | |
|---|---|
| ***F04D 25/08*** | (2006.01) |
| ***F04D 29/34*** | (2006.01) |
| ***F04D 29/64*** | (2006.01) |
| *F04D 29/66* | (2006.01) |

(52) U.S. Cl.

CPC ..... *F04D 29/34* (2013.01); *F04D 25/088* (2013.01); *F04D 29/646* (2013.01); *F04D 29/668* (2013.01)

(58) Field of Classification Search

CPC ..... F04D 25/088; F04D 29/34

See application file for complete search history.

(56) References Cited

U.S. PATENT DOCUMENTS

| | | | | |
|---|---|---|---|---|
| 5,304,037 A * | 4/1994 | Scofield | F04D 29/34 416/134 R |
| 6,022,189 A * | 2/2000 | Yu | F04D 25/088 416/170 R |
| 6,250,884 B1 * | 6/2001 | Huang | F04D 25/088 416/207 |
| 7,481,626 B2 | 1/2009 | Gajewski | |

* cited by examiner

*Primary Examiner* — Craig Kim
*Assistant Examiner* — Michael Sehn
(74) *Attorney, Agent, or Firm* — Michael W. Goltry; Robert A. Parsons; Parsons & Goltry

(57) ABSTRACT

A ceiling fan suspended by a down rod includes a motor that rotates relative to the down rod. The motor has a side extending between a top and an opposed bottom, a brace is releasably attached to top of the motor, and a blade iron is releasably attached to the bottom of the motor. A fan blade has a face plate juxtaposed along the side of the motor and is releasably attached to the blade iron. An engagement element formed in the brace mates with a complemental engagement element formed in the face plate so as to connect the brace with respect to the face plate, and the engagement element of the brace and the complemental engagement element of the face plate concurrently contact a vibration dampener applied between the engagement element and the complemental engagement element to dampen vibration between the brace and the fan blade.

24 Claims, 7 Drawing Sheets

CEILING FAN

FIELD OF THE INVENTION

The present invention relates to ceiling fans.

BACKGROUND OF THE INVENTION

A typical ceiling fan includes a motor shaft connected to a lower portion of a down rod assembly suspended from the ceiling. A motor is coupled to rotate about the motor shaft, and a motor housing surrounds the motor and is secured either to the motor shaft or to the down rod assembly, which remain stationary. Blade mounting arms, also known as blade irons, are connected to the motor and extend outwardly with respect to the motor housing, and a fan blade is attached to each of the blade irons.

Conventional blade irons are releasably attached to the fan blades and to the fan housing. Specifically, known blade irons have proximal extremities or ends releasably attached to the motor, and opposed distal extremities or ends releasably attached to their respective fan blades. In addition to their primary function of releasably securing the fan blades to the motor of the ceiling fan, conventional blade irons are normally exposed relative to the other structures of the ceiling fan and are, therefore, normally decorative or ornamental in nature and enhance the overall appearance of the ceiling fan. Often, the decorative or ornamental characteristics of blade irons are chosen to match the décor of the environment where the ceiling fan is installed.

The use of conventional blade irons to attach fan blades to a fan motor contributes to the overall cost of a ceiling fan, particularly with blade irons that are ornate, intricately shaped, or large. Blade irons also add to the overall weight of a ceiling fan. Additionally, it is a common commercial practice for ceiling fans to be shipped to the end user unassembled, which necessitates assembly prior to, or during, installation. However, blade irons do provide a reliable way to secure fan blades to the fan motor. Accordingly, it would be highly desirable to provide a ceiling fan and blade iron assembly that not only eliminates the need to incorporate expensive decorative or aesthetically-pleasing attributes in the blade iron, but that also provides a way to reduce the overall size of the blade iron all while still providing a reliable coupling between the fan motor and the fan blade.

SUMMARY OF THE INVENTION

According to the principle of the invention, a ceiling fan suspended by a down rod includes a motor that rotates relative to the down rod. The motor includes a first end, an opposed second end, and a side extending between the first end and the opposed second end. A brace is attached to the first end of the motor. The brace is preferably releasably attached to the first end of the motor so as to be separable from the first end of the motor. A blade iron is attached to the second end of the motor. The blade iron is preferably releasably attached to the second end of the motor opposite to the brace so as to be separable from the second end of the motor. The ceiling fan includes a fan blade. The fan blade includes a face plate having opposed first and second side marginal edges extending between opposed first and second end marginal edges, opposed inner and outer faces that extend between the opposed first and second side marginal edges and the opposed first and second end marginal edges, and a bracket formed in the inner face of the face plate. The face plate is juxtaposed along the side of the motor, the inner face of the face plate faces the side of the motor and the outer face of the face plate faces away from the side of the motor, and the bracket of the face plate is attached to the blade iron. Preferably, the bracket of the face plate is releasably attached to the blade iron so as to be separable from the blade iron. An engagement element is formed in the brace and mates with a complemental engagement element formed in the second end marginal edge of the face plate so as to connect the brace with respect to the second end marginal edge of the face plate. The engagement element of the brace and the complemental engagement element of the face plate concurrently contact a vibration dampener applied between the engagement element and the complemental engagement element to dampen vibration between the brace and the fan blade. The bracket is located near the first end marginal edge between the first and second end marginal edges. The blade iron is located between the first and second end marginal edges. The second end marginal edge has a length that extends from the first side marginal edge to the second side marginal edge, and the complemental engagement element extends along the length of the second end marginal edge from the first side marginal edge to the second side marginal edge. The complemental engagement element is unbroken. The engagement element is received by, and extends along the length of, the complemental engagement element from the first side marginal edge to the second side marginal edge. The engagement element is one of a tongue and a groove, and the complemental engagement element is the other one of the tongue and the groove. The vibration dampener is a soft, flexible material.

According to the principle of the invention, a ceiling fan suspended by a down rod includes a motor that rotates relative to the down rod. The motor includes a top, an opposed bottom, and a side extending between the top and the opposed bottom. A brace is attached to the top of the motor. Preferably, the brace is releasably attached to the top of the motor so as to be separable from the top of the motor. A blade iron is attached to the bottom of the motor. Preferably, the blade iron is releasably attached to the bottom of the motor opposite to the brace so as to be separable from the bottom of the motor. The ceiling fan includes a fan blade, which includes a face plate having opposed first and second side marginal edges extending between opposed upper and lower end marginal edges, opposed inner and outer faces that extend between the opposed first and second side marginal edges and the opposed upper and lower end marginal edges, and a bracket formed in the inner face of the face plate. The face plate extends upright along the side of the motor from the lower end marginal edge near the bottom of the motor to the upper end marginal edge near the top of the motor, the inner face of the face plate faces the side of the motor and the outer face of the face plate faces away from the side of the motor, and the bracket of the face plate is attached to the blade iron. Preferably, the bracket of the face plate is releasably attached to the blade iron so as to be separable from the blade iron. An engagement element formed in the brace mates with a complemental engagement element formed in the upper end marginal edge of the face plate so as to connect the brace with respect to the upper end marginal edge of the face plate. The engagement element of the brace and the complemental engagement element of the face plate concurrently contact a vibration dampener applied between the engagement element and the complemental engagement element to dampen vibration between the brace and the fan blade. The bracket is located near the lower end marginal edge between the upper and lower end marginal edges. The blade iron is located between the upper and lower end marginal edges. The upper end marginal edge has a length that extends from the first side marginal edge to the second side marginal edge, and the complemental engagement element extends along the length of the upper end marginal edge from the first side marginal edge to the second side marginal edge. The complemental engagement element is unbroken. The engagement element is received by, and extends along the length of, the complemental engagement element from the first side marginal edge to the second side marginal edge. The engagement element is one of a tongue and a groove, and the complemental engagement element is the other one of the tongue and the groove. The vibration dampener is a soft, flexible material.

A ceiling fan suspended by a down rod includes a motor that rotates relative to the down rod about an axis of rotation. The motor includes a top, an opposed bottom, and a side extending between the top and the opposed bottom. A continuous, annular brace encircles the axis of rotation and is releasably attached to the top of the motor so as to be separable from the top of the motor, and the brace extends radially outward with respect to the axis of rotation and terminates with a marginal perimeter edge located outboard of the side of the motor. A blade iron is releasably attached to the bottom of the motor opposite to the brace so as to be separable from the bottom of the motor. The ceiling fan includes a fan blade, which includes a face plate having opposed first and second side marginal edges extending between opposed upper and lower end marginal edges, opposed inner and outer faces that extend between the opposed first and second side marginal edges and the opposed upper and lower end marginal edges, and a bracket formed in the inner face of the face plate. The face plate extends upright along the side of the motor from the lower end marginal edge near the bottom of the motor to the upper end marginal edge near the top of the motor, the inner face of the face plate faces the side of the motor and the outer face of the face plate faces away from the side of the motor, and the bracket of the face plate is releasably attached to the blade iron so as to be separable from the blade iron. An engagement element formed in the marginal perimeter edge of the brace mates with a complemental engagement element formed in the upper end marginal edge of the face plate so as to connect the brace with respect to the upper end marginal edge of the face plate. The engagement element of the brace and the complemental engagement element of the face plate concurrently contact a vibration dampener applied between the engagement element and the complemental engagement element to dampen vibration between the brace and the fan blade. The bracket is located near the lower end marginal edge between the upper and lower end marginal edges. The blade iron is located between the upper and lower end marginal edges. The upper end marginal edge has a length that extends from the first side marginal edge to the second side marginal edge, and the complemental engagement element extends along the length of the upper end marginal edge from the first side marginal edge to the second side marginal edge. The complemental engagement element is unbroken. The engagement element formed in the perimeter marginal edge of the brace is received by, and extends along the length of, the complemental engagement element from the first side marginal edge to the second side marginal edge. The engagement element is one of a tongue and a groove, and the complemental engagement element is the other one of the tongue and the groove. The vibration dampener comprises a soft, flexible material.

Consistent with the foregoing summary of preferred embodiments, and the ensuing detailed description, which are to be taken together, the invention also contemplates associated apparatus and method embodiments.

BRIEF DESCRIPTION OF THE DRAWINGS

Referring to the drawings.

DETAILED DESCRIPTION

Figure 1:
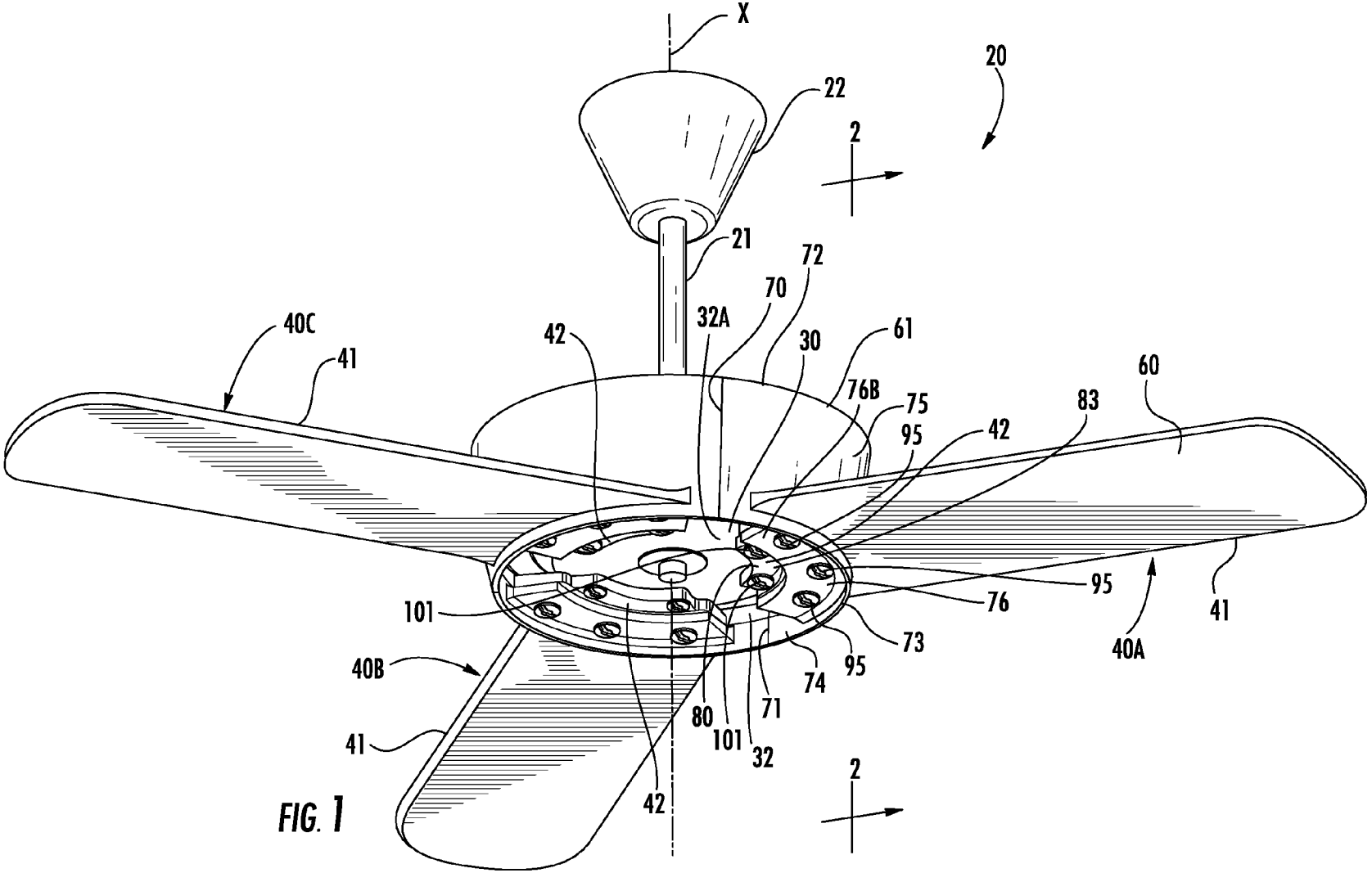
FIG. 1 is a perspective view of a ceiling fan constructed and arranged in accordance with the principle of the invention, the ceiling fan being suspended by a down rod and including blade irons releasably attached between fan blades and a motor that rotates relative to the down rod.

Turning now to the drawings, in which like reference characters indicate corresponding elements throughout the several views, attention is first directed to FIG. 1 in which there is seen a ceiling fan 20 constructed and arranged in accordance with the principle of the invention and which is connected to a down rod 21 that is suspended from the ceiling via a ceiling mount denoted generally at 22. Ceiling fan 20 includes a motor 30 conventionally connected to down rod 21, and fan blade assemblies 40 attached to motor 30, which rotate with motor 30 in the operation of ceiling fan 20 so as to produce a current of air. Motor 30 is conventional in that it rotates relative to down rod 21 about axis of rotation X, referenced in FIGS. 1 and 2, when ceiling fan 20 is in operation. Referencing FIG. 2, which is a section view taken along line 2-2 of FIG. 1, motor 30 includes opposed ends 31 and 32 and a side 33 extending between ends 31 and 32. End 31 is an upper end of motor 30 and includes or otherwise defines a top 31A of motor 30, and end 32 is a lower end of motor 30 and includes or otherwise defines a bottom 32A of motor 30 opposite to top 31A of motor 30. Top 31A and bottom 32A of motor 30 are parallel with respect to each other.

Figure 2:
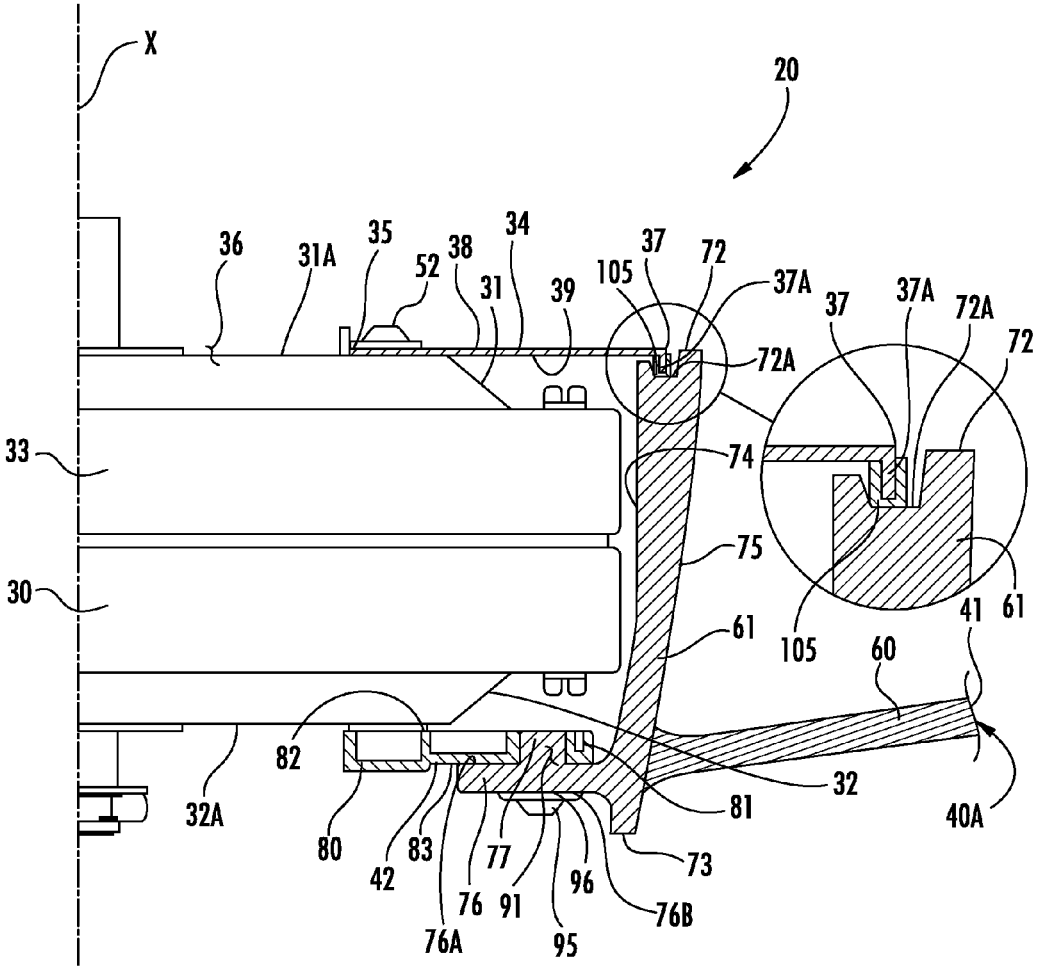
FIG. 2 is a section view taken along line 2-2 of FIG. 1 illustrating the motor having a top and an opposed bottom, a brace and a blade iron attached to the top and bottom, respectively, of the motor, and a fan blade coupled between the blade iron and the brace.

In reference to FIG. 2, ceiling fan 20 includes a brace 34, and, as referenced in FIGS. 1 and 2, one or more fan blade assemblies 40A,40B,40C. Ceiling fan 20 incorporates three fan blade assemblies 40A,40B,40C, and less or more may be incorporated into a ceiling fan constructed and arranged in accordance with the principle of the invention as herein specifically described. Brace 34 is considered a part of motor 30, or otherwise an extension of motor 30. Fan blade assemblies 40A,40B,40C are identical and each includes a fan blade denoted at 41 and an attached blade iron denoted generally at 42. Brace 34 is attached to top 31A of upper end 31 of motor 30 as shown in FIG. 2. Referencing FIGS. 1, 2, 7, and 8 in relevant part, blade irons 42 are attached to bottom 32A of lower end 32 of motor 30 being diametrically opposed with respect to brace 34, and a fan blade 41 is coupled between brace 34 and each blade iron 42 so as to attach fan blades 41 to motor 30. Brace 34 is preferably releasably attached to top 31A of upper end 31 of motor 30 so as to be separable from top 31A of upper end 31 of motor 30. Each blade iron 42 is preferably releasably attached to bottom 32A of lower end 32 of motor 30 opposite to brace 34 so as to be separable from bottom 32A of lower end 32 of motor 30. Fan blades 41 are, in turn, each preferably releasably attached to, so as to be separable from, a corresponding one of blade irons 42.

Figure 3:
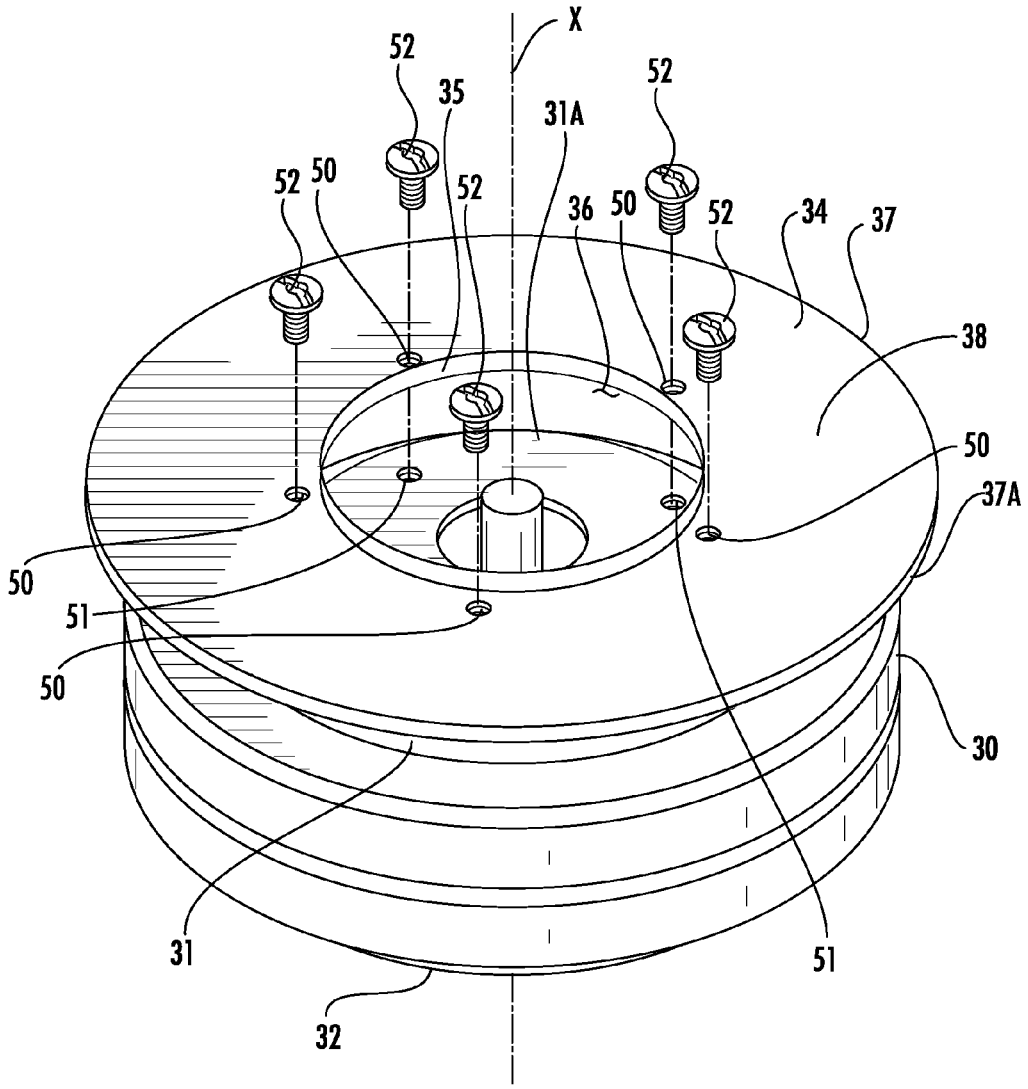
FIG. 3 is a perspective view of the brace of FIG. 2 shown as it would appear in preparation for attachment to the motor.
Figure 5:
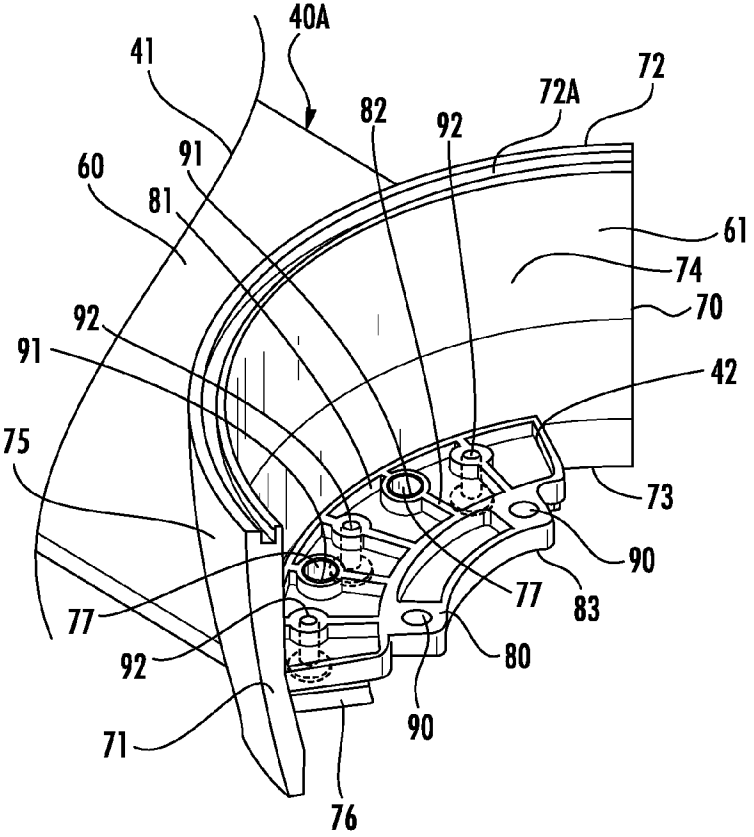
FIG. 5 is a view similar to that of FIG. 4 illustrating the blade iron as it would appear attached to the fan blade.
Figure 4:
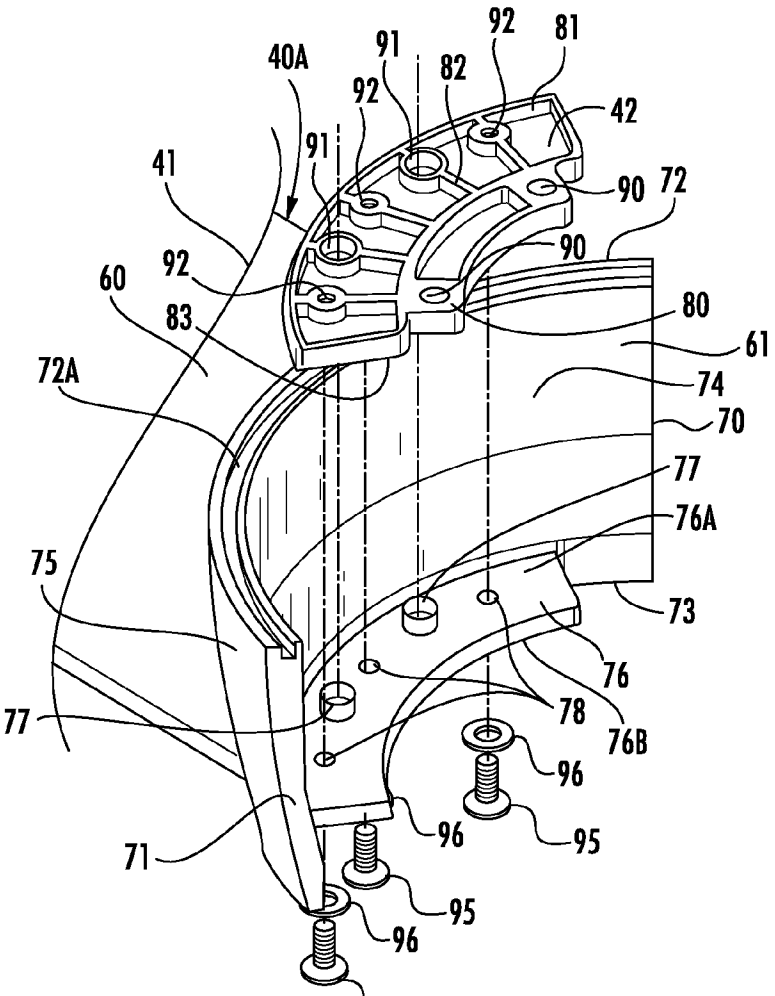
FIG. 4 is a fragmented perspective view of a fan blade of the ceiling fan of FIG. 1 and further illustrating a blade iron shown as it would appear positioned in preparation for attachment to the fan blade.

Looking now in relevant part to FIGS. 2 and 3, brace 34 is formed of sheet stock of metal, plastic, or other material or combination of materials having the inherent material characteristics or properties of rigidity, flexibility, resilience, and impact resistance, and is a cap in the form of a disk being a thin, flat, circular or rounded, continuous, annular body or plate that has a continuous marginal inner edge 35 encircling a central opening 36, an opposed continuous marginal outer or perimeter edge 37 formed with a tongue 37A, opposed upper and lower parallel surfaces 38 and 39 extending from and between marginal inner edge 35 and perimeter edge 37, and an array of fastener openings 50, which extend through brace 34 from upper surface 38 to lower surface 39. Openings 50 are formed in brace 34 between marginal inner edge 35 and marginal perimeter edge 37 and, more specifically, are located near marginal inner edge 35 and are equally spaced-apart and encircle opening 36. Tongue 37A depends from perimeter edge 37 in a direction downwardly from lower surface 39. Tongue 37A is uniform and unbroken along the full length of perimeter edge 37 and depends from the entirety of perimeter edge 37 and is continuous and is circular so as to define or otherwise have a circular curvature.

Figure 6:
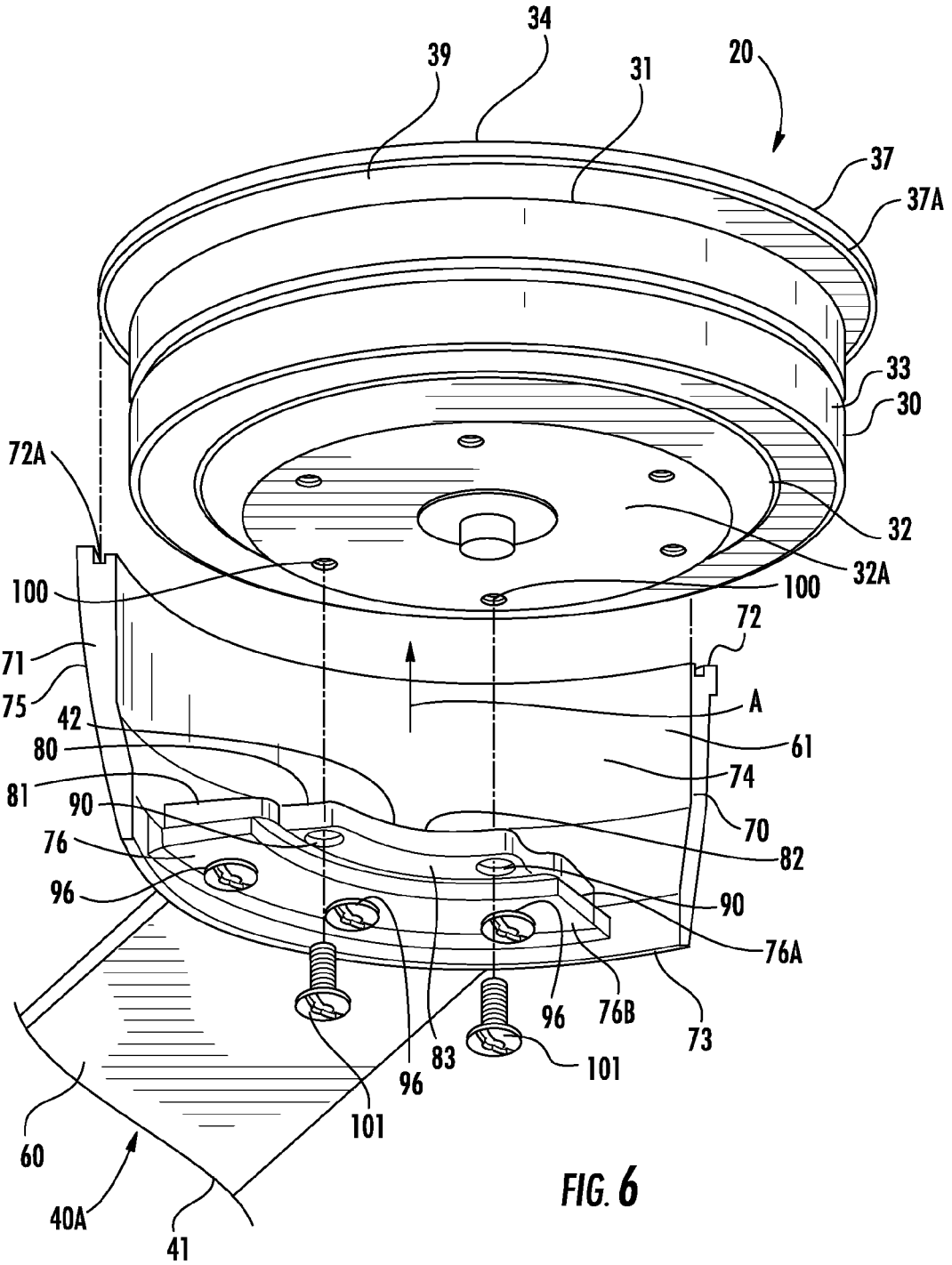
FIG. 6 is a view of the blade iron and the fan blade similar to that of FIG. 5 and further shown as they would appear in preparation for attachment to the motor.

In regards to the installation of brace 34 to motor 30, an annular area or portion of lower face 39 of brace 34 near marginal inner edge 35 is applied directly atop and against top 31A of upper end 31 of motor 30, as shown in FIG. 2, and brace 34 is positioned so as to cause opening 36 and perimeter edge 37 and tongue 37A to be coaxial with respect to, and to encircle, axis of rotation X of motor 30, and to align openings 50 formed in brace 34 with a corresponding array of threaded openings, only two of which are shown in FIG. 3 and are each denoted at 51, formed in top 31A of upper end 31 of motor 30. Threaded fasteners 52 in the form of screws are threaded into threaded openings 51 formed in top 31A of upper end 31 of motor 30 via the corresponding openings 50 of brace 34, and are tightened via rotation so as to firmly and releasably attach brace 34 to top 31A of upper end 31 of motor 30, wherein brace 34 is parallel with respect to top 31A and bottom 32A of upper and lower ends 31 and 32, respectively, and extends radially outward with respect to axis of rotation X and terminates with marginal perimeter edge 37 and tongue 37A located uniformly outboard of side 33 of motor 30 at upper end 31 and top 31A of motor 30 as illustrated in relevant part in FIG. 2, FIG. 6, FIG. 7, and FIG. 7, and wherein tongue 37A is directed or otherwise points downwardly toward bottom 32A and lower end 32 of motor 30. So installed, brace 34 is symmetrical about axis of rotation X, which extends through, and is coaxial with respect to, opening 36. Being so releasably attached to top 31A of upper end 31 of motor 30 with threaded fasteners 52 in the form of screws, brace 34 is separable from motor 30 to as to be detachable from motor 30 simply by reversing this installation operation of brace 34 relative to motor 30, namely, by loosening, unthreading, and releasing threaded fasteners 52 via rotation and by then taking brace 34 up, such as by hand, and removing brace 34 from motor 30.

In the preferred embodiment brace 34 is releasable attached to top 31A of upper end 31 of motor 30 with threaded fasteners 52 applied between brace 34 and motor 30 as herein specifically described, and one or more clamps, pins, or other form of mechanical fasteners can be used to releasably attach brace 34 to motor 30. The described releasable attachment of brace 34 to motor 30 allows brace 34 to be removed for cleaning, repair, or replacement. In an alternate embodiment, brace 34 may be immovably affixed so as to be inseparable from motor 30, such as by welding, integrally forming brace 34 with motor 30, or the like.

Fan blade assemblies 40A,40B,40C of ceiling fan 20, including the corresponding fan blades 41 and blade irons 42, are identical in every respect as first explained above. Accordingly, the details of the fan blade and the blade iron of one fan blade assembly will now be discussed in detail, with the understanding that the ensuing discussion applies equally to each of the fan blade and the blade iron of each one of the fan blade assemblies 40A,40B,40C. For ease of discussion and reference, fan blade assembly 40A is discussed below in connection in relevant part to FIGS. 1, 2, and 4-8.

Fan blade assembly 40A includes fan blade 41 and blade iron 42. Fan blade 41 is made up of two main components, including a blade 60 and a face plate 61. Blade 60 and face plate 61 are preferably contiguous or otherwise integrally formed so as to be inseparable from each other, but may be formed separately and then joined together if so desired, such as by adhesive, welding, or other form of joinery. Face plate 61 includes opposed side marginal edges 70 and 71 that each have a length and that extend between opposed upper and lower end marginal edges 72 and 73 that each have a length and that extend between side marginal edges 70 and 71, and opposed inner and outer surfaces or faces 74 and 75 that extend between the opposed side marginal edges 70 and 71 and the opposed upper and lower end marginal edges 72 and 73, and a bracket 76 in the form of a flat, curved plate. Side marginal edges 70 and 71 are substantially parallel relative to each other and are substantially perpendicular with respect to upper end lower end marginal edges 72 and 73, which are, in turn, substantially parallel relative to each other.

Face plate 61, including upper and lower end marginal edges 72 and 73, is uniformly curved or otherwise arcuate in a horizontal direction from side marginal edge 71 to side marginal edge 72 as illustrated, characterized in the that inner face 74 is inwardly curved in a horizontal direction from side marginal edge 70 to side marginal edge 71, and outer face 75 is outwardly curved in a horizontal direction from side marginal edge 70 to side marginal edge 71. Bracket 76 is formed in, and extends outwardly from, inner face 74 of face plate 61 and has a curvature that matches the curvature of inner face 74 as illustrated, and is located between upper and lower end marginal edges 72 and 73 being further located near or otherwise proximate to lower end marginal edge 73 of face plate 61 being closer to lower end marginal edge 73 than to upper end marginal edge 72. Bracket 76 is part of face plate 61, and bracket 76 and face plate 61 are contiguous or otherwise integrally formed so as to be inseparable from each other, but may be formed separately and then joined together if so desired, such as by adhesive, welding, or other form of joinery. Blade 60 extends horizontally outwardly from outer face 75 of face plate 61 in a direction opposite to that of bracket 76 from a location between upper and lower end marginal edges 72 and 73 and, more specifically, near or otherwise proximate to lower end marginal edge 73 of face plate 61. Blade 60 can extend from any location of outer face 75 of faceplate from upper end marginal edge 72 to lower end marginal edge 73 in other embodiments as may be desired without departing from the invention.

Bracket 76 has an upper surface or face 76A, and an opposed lower surface or face 76B. Bracket 76 is formed with alignment lugs 77 and fastener openings 78. Alignment lugs 77 are spaced apart from one another and are uniform being equal in size and shape and project upwardly with respect to upper face 76A of bracket 76. Openings 78 are equally spaced apart from one another and are spaced apart from alignment lugs 77, and extend through bracket 76 from upper face 76A to lower face 76B. Bracket 76 is adapted to be releasably attached to blade iron 42 so as to be separable from blade iron 42, and blade iron 42 is, in turn, adapted to be releasably attached to bottom 32A of lower end 32 of motor 30 so as to be separable from bottom 32A of motor 32.

As first indicated above, face plate 61, including upper and lower end marginal edges 72 and 73, is uniformly curved or otherwise arcuate in a horizontal direction, wherein the lengths of upper and lower end marginal edges 72 and 73 each form a segment of a circle, namely, an arc of a circle. The circular curvature of the arc of a circle formed or otherwise defined by upper end marginal edge 72 relates to the curvature of tongue 37A, in accordance with the principle of the invention. A groove 72A is formed centrally in upper end marginal edge 72. Upper end marginal edge 72 has a length that extends from side marginal edge 70 to side marginal edge 71, and groove 72A extends centrally along the length of upper end marginal edge 72 from side marginal edge 70 to side marginal edge 71 and, as a result, matches the circular curvature of the arc of a circle formed or otherwise defined by upper end marginal edge 72 and, in turn, corresponds to or otherwise relates to or matches the curvature of tongue 37A formed along perimeter edge 37 of brace 34. Groove 72A is continuous, uniform, and unbroken along the length of upper end marginal edge 72 from side marginal edge 70 to side marginal edge 71 and relates to and is sized to accept a corresponding length tongue 37A, namely, a segment of tongue or otherwise an arc of a circle of segment of tongue 37A matching the arc of a circle length of groove 72A from side marginal edge 70 to side marginal edge 71, in accordance with the principle of the invention.

Blade iron 42 is machined, cast, assembled, or otherwise formed of plastic, metal, or other material or combination of materials having the inherent material characteristics or properties of rigidity, resilience, and impact resistance. Blade iron 42 has a proximal attachment extremity or end 80 adapted to be releasably attached to bottom 32A of lower end 32 of motor 32 so as to be separable from bottom 32A of motor 32, an opposed distal attachment extremity or end 81 adapted to be releasably attached to bracket 76 of face plate 61 of fan blade 40A so as to be separable from bracket 76 of fan blade 40A, a top or upper side 82, and an opposed bottom or lower side 83.

Openings are formed in proximal attachment extremity 80 for use in attaching blade iron 42 to motor 30, and different openings are formed in distal attachment extremity 81 for use in attaching blade iron to fan blade 41. The openings formed in proximal attachment extremity 80 of blade iron 42 are fastener openings 90, and the openings formed in distal attachment extremity 81 are alignment openings 91 and threaded fastener openings 92. Fastener openings 90 extend through proximal attachment extremity 80 of blade iron 42 from upper side 82 to lower side 83. Alignment openings 91 are spaced apart from one another and are uniform being equal in size and shape and extend through distal attachment extremity 81 of blade iron 42 from upper side 82 to lower side 83 and relate to lugs 77 formed in bracket 76. Fastener openings 92 are equally spaced apart from one another and are spaced apart from alignment openings 91, and extend through distal attachment extremity 81 of blade iron 42 from upper side 82 to lower side 83 and relate to openings 78 formed in bracket 76.

In the installation of blade iron 42 to fan blade 41 so as to form fan blade assembly 40A, an area or portion of lower side 83 of blade iron 42 is aligned with upper face 76 of bracket 76 so as to alignment openings 91 of blade iron 42 with lugs 77 of bracket 76 and so as to align fastener openings 92 of blade iron 42 with fastener openings 78 of bracket 76. Blade iron 42 and bracket 76 are brought together along inner face 74 of face plate 61 so as to initially apply lugs 77 into alignment openings 91 which, in so doing, aligns fastener openings 92 of blade iron with fastener openings 78 of bracket 76. Blade iron 42 and bracket 76 are then moved toward against one another so as to bring the area or portion of lower side 83 of blade iron into direct contact with upper face 76A of bracket 76 along inner face 74 of face plate 61 and so as to fully apply lugs 77 into alignment openings 91, which keeps fastener openings 92 of blade iron 42 aligned with fastener openings 78 of bracket 76, and in this positioning of blade iron 42 it is to be understood that blade iron 42 is located between upper and lower end marginal edges 72 and 73 of face plate 61 and, more specifically, between bracket 76 and upper end marginal edge 72.

Threaded fasteners 95 in the form of screws are threaded into threaded fastener openings 92 of blade iron 42 via fastener openings 78 of bracket 76 in a direction from lower face 76B of bracket 76, and are tightened via rotation so as to firmly and releasably attach distal attachment extremity 81 of blade iron 42 in place to bracket 76 so as to releasably attach blade iron 42 to fan blade 41. Preferably, a washer 96 encircles each threaded fastener 95 is applied between the head of each of the threaded fasteners 95 and lower face 76B of bracket 76 to give tightness to the respective joints. Being so releasably attached to bracket 76 with threaded fasteners 95 in the form of screws, blade iron 42 is separable from bracket 76 as to be separable and detachable from fan blade 41 simply by reversing this installation operation of blade iron 42 relative to fan blade 41, namely, by loosening, unthreading, and releasing threaded fasteners 95 via rotation and by then taking blade iron 42 up, such as by hand, and removing blade iron 42 from bracket 76 of fan blade 41.

In the preferred embodiment blade iron 42 is releasable attached to bracket 76 of face plate 61 of fan blade 41 with threaded fasteners 96 applied between distal attachment extremity 81 of blade iron 42 and bracket 76 of fan blade 41 as herein specifically described, and one or more clamps, pins, or other form of mechanical fasteners can be used to releasably attach blade iron 42 to fan blade 41 without departing from the invention. The described releasable attachment of blade iron 42 to fan blade 41 allows blade iron 42 and fan blade 41 to be detached and removed from one another for cleaning, repair, or replacement.

Figure 7:
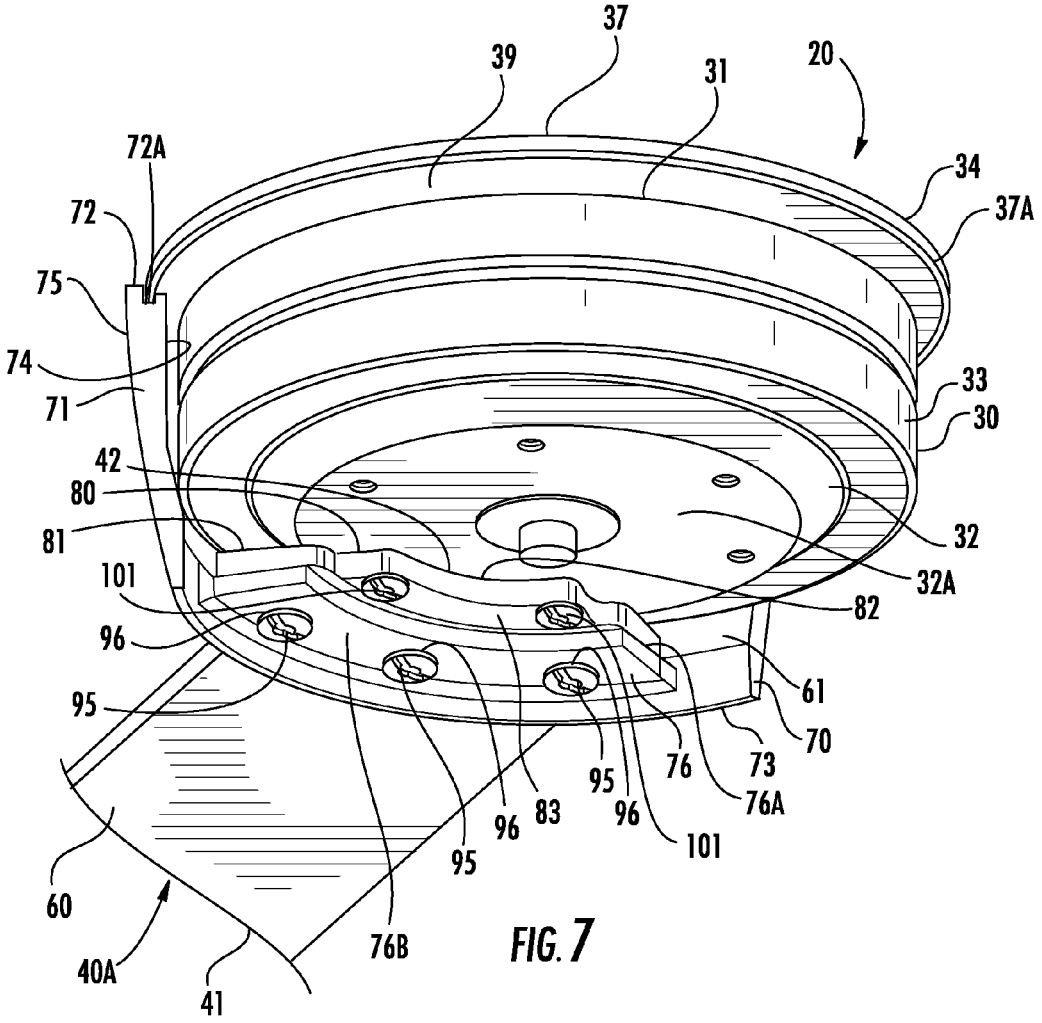
FIG. 7 is a view similar to that of FIG. 6 illustrating the blade iron attached between the motor and the fan blade.
Figure 8:
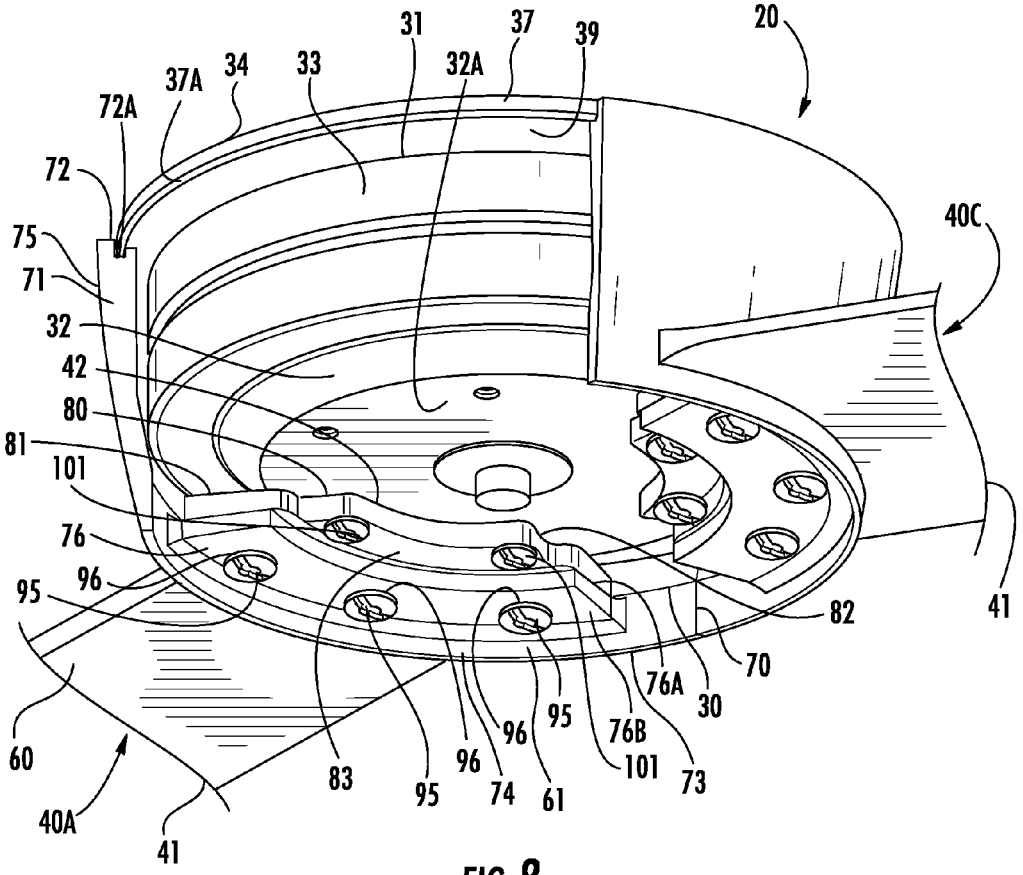
FIG. 8 is a view similar to that of FIG. 7 illustrating opposed blade irons attached between the motor and corresponding fan blades.

In the installation of fan blade assembly 40A to motor 30, fan blade assembly 40A is taken up and held with face plate 61 extending upright from lower end marginal edge 73 to upper end marginal edge 72 with inner face 74 of face plate 61 directed toward side 33 of motor 30 and under bottom 32A of lower end 32 of motor 30 so as to direct upper side 82 of blade iron 42 toward bottom 32A of lower end 32 of motor 30 and so as to align fastener openings 90 formed in proximal attachment end 80 of blade iron 42 with corresponding threaded openings 100 formed in bottom 32A of lower end 32 of motor 30. Fan blade assembly 40A is moved upwardly toward bottom 32A of lower end 32 of motor in the direction of arrowed line A in FIG. 6 so as to concurrently apply face plate 61 near and opposite to, or otherwise in juxtaposition with respect to, side 33 of motor 30, apply tongue 37A of brace 34 to groove 72A formed in upper end marginal edge 72 of face plate, and apply an area or portion of upper side 82 of blade iron 42 directly against bottom 32A of lower end 32 of motor 30 as shown in FIGS. 7 and 8, all while aligning fastener openings 90 formed in proximal attachment end 80 of blade iron 42 with the corresponding threaded openings 100 (FIG. 6) formed in bottom 32A of lower end 32 of motor 30. The application of tongue 37A to groove 72A is characterized in that a length of tongue 37A mates with, or is otherwise matingly receive by, groove 72A, and extends continuously along the full length of groove 72A from side marginal edge 70 to side marginal edge 71. Threaded fasteners 101 in the form of screws are threaded into threaded openings 100 (FIG. 6) formed in bottom 32A of lower end 32 of motor 30 via the corresponding fastener openings 90 (FIG. 6) of blade iron 42, and are tightened via rotation so as to releasably attach blade iron 42 to bottom 32A of lower end 32 of motor 30, wherein blade iron 42 is parallel with respect to brace 34 and to top 31A and bottom 32A of upper and lower ends 31 and 32, respectively, is diametrically opposed with respect to brace 34 and extends radially outward with respect to axis of rotation X toward side 33 of motor 30 from proximal attachment end 80 to distal attachment end 81 directed toward inner face 74 of face plate 61. The mating application of tongue 37A of brace 34 to groove 72A formed in upper end marginal edge 72 of face plate 72 connects brace 34 to face plate 61 of fan blade 41 of fan blade assembly 40A, or otherwise forms a coupling between brace 34 and face plate 61 of fan blade 41 at upper end marginal edge 72 of face plate 61, and without the aid of one or more invasive fasteners, such as screws or rivets or other form of invasive fastener.

Being so releasably attached to bottom 32A of lower end 32 of motor 30 with threaded fasteners 101 in the form of screws, blade iron 42, and thus fan blade assembly 40A, is separable from motor 30 to as to be detachable from motor 30 simply by reversing this installation operation of blade iron 42 relative to motor 30, namely, by loosening, unthreading, and releasing threaded fasteners 101 via rotation and by then taking fan blade assembly 41 up, such as by hand, and removing fan blade assembly 41, and thus blade iron 42, from motor 30, and removing tongue 37A of brace 34 from groove 72A of face plate 72. In the preferred embodiment blade iron 42 of fan blade assembly 40A is releasable attached to bottom 32A of lower end 32 of motor 30 with threaded fasteners 101 applied between blade iron 42 and motor 30 as herein specifically described, and one or more clamps, pins, or other form of mechanical fasteners can be used to releasably attach blade iron 42 to motor 30. The described releasable attachment of blade iron 42, and thus fan blade assembly 40A, to motor 30 allows blade iron 42, and thus fan blade assembly 40A, to be removed for cleaning, repair, or replacement.

In the installation of fan blade assembly 40A to bottom 32A of lower end 32 of motor 30 in reference to FIG. 2, face plate 61 extends upright along the side 33 of motor 30 from lower end marginal edge 73 near bottom 32A and lower end 32 of motor 30 to upper end marginal edge 72 at tongue 37A formed in perimeter edge 37 of brace 34 near top 31A and upper end 31 of motor 30, bracket 76 is located near lower end marginal edge 73 between upper and lower end marginal edges 72 and 73 of face plate 61, and blade iron 42 is located between upper and lower end marginal edges 72 and 73 and, more specifically, between bracket 76 and upper end marginal edge 72. Inner face 74 of face plate 61 faces interiorly to side 33 of motor 30 and outer face 75 of face plate 61 faces exteriorly away from side 33 of motor 30 and fan blade 60 extends outwardly from outer face 75 of face plate 61 so as to be available to move air in response to rotation of motor 30 in the conventional manner. Tongue 37A formed in perimeter edge 37 of brace 34 mates with groove 72A in that tongue 37A is matingly received by groove 72A formed in upper end marginal edge 72 of face plate 61 and extends along the length of groove 72A from side marginal edge 70 of face plate 61 to side marginal edge 71 of face plate 61 so as to connect brace 34 with respect to upper end marginal edge 72 of face plate. Because blade iron 42 is releasably coupled to fan blade 41 and is concurrently coupled to brace 34 via the mating application of tongue 37A formed in perimeter edge 37 of brace 34 to groove 72A formed in upper end marginal edge 72 of face plate 61 of fan blade 41, fan blade 41 is coupled between blade iron 42 and brace 34, in accordance with the principle of the invention. Moreover, the coupling of fan blade 41 to blade iron 42 at bracket 76 and to brace 34 defines a major two-point coupling of fan blade 41 proximate to the opposed upper and lower end marginal edges 72 and 73 of face plate 61 extending along the side 33 of motor 30, which provides a firm and reliable coupling of fan blade 41 relative to motor 30, in accordance with the principle of the invention.

In a particular embodiment with specific reference to FIG. 2, it is illustrated that tongue 37A and groove 72A concurrently contact a vibration dampener denoted at 105. Vibration dampener 105 is applied between tongue 37A and groove 72A, and functions to dampen vibration between brace 34 and fan blade 41 at upper end marginal edge 72, in accordance with the principle of the invention, to provide quiet operation when ceiling fan 20 is in operation. The vibration dampener 105 is a soft, flexible material, such as soft, flexible rubber, cloth, felt, or other material or combination of materials having the material characteristics or properties of softness, flexibility, and vibration absorption. In FIG. 2, vibration dampener 105 is preferably carried by tongue 37A, and is attached/affixed to tongue 37A with adhesive, lamination, heat-bonding, or the like. In an alternate embodiment, vibration dampener 105 is carried by groove 72A, such as by lining groove 72A with the soft, flexible material that constitutes vibration dampener 105 and adhering/affixing vibration dampener in place, such as with adhesive, lamination, heat-bonding, etc.

The remaining fan blade assemblies 40B,40C are attached to motor 30 in a manner identical to the described installation of fan blade assembly 40A, and face plates 61 of the various fan blade assemblies 40A,40B,40C surround side 33 (not shown in FIG. 1) of motor 33 and are arranged side marginal edge 71 to side marginal edge 72 so as to cooperate to form or otherwise define a motor housing surrounding side 33 (not shown in FIG. 1) of motor 30. Motor 30, brace 34, and fan blade assemblies 40A,40B,40C concurrently rotate in the rotation of motor 30 in the operation of ceiling fan 20 so as to produce a current of air. Tongue 37A of brace 34 is applied concurrently to grooves 72A of each one of the fan blade assemblies 40A,40B,40C in the manner described above in connection with fan blade assembly 40A.

In the present embodiment, tongue 37A is exemplary of an engagement element of an engagement assembly/pair in the form of a male engagement element that is matingly received in groove 72A so as to connect to groove 72A, which, in turn is exemplary of a corresponding complemental engagement element of the engagement assembly/pair in the form of a female engagement element. Although the male engagement element of the disclosed engagement assembly/pair in the form of tongue 37A is carried by or otherwise formed in brace 34 and the corresponding female engagement element of the engagement assembly/pair in the form of groove 72A is carried by or otherwise formed in face plate 61 as herein specifically described, this arrangement can be reversed in an alternate embodiment. Furthermore, for the purposes of illustration and reference it is to be noted that vibration dampener 105 is shown and described in conjunction only with FIG. 2. In a particular embodiment, vibration dampener 105 may be unbroken and applied concurrently between the full extent of tongue 37A and the groove 72A of each one of the fan blade assemblies 40A, 40B,40C. In this embodiment, vibration dampener 105 is carried by tongue 37A and is unbroken and extends continuously along tongue 37A.

The invention has been described above with reference to preferred embodiments. However, those skilled in the art will recognize that changes and modifications may be made to the embodiments without departing from the nature and scope of the invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A ceiling fan suspended by a down rod, the ceiling fan comprising:

a motor that rotates relative to the down rod, the motor includes a first end, an opposed second end, and a side extending between the first end and the opposed second end;

a brace releasably attached to the first end of the motor so as to be separable from the first end of the motor;

a blade iron releasably attached to the second end of the motor opposite to the brace so as to be separable from the second end of the motor;

a fan blade, the fan blade comprises a face plate including opposed first and second side marginal edges extending between opposed first and second end marginal edges, opposed inner and outer faces that extend between the opposed first and second side marginal edges and the opposed first and second end marginal edges, and a bracket formed in the inner face of the face plate;

the face plate is juxtaposed along the side of the motor, the inner face of the face plate faces the side of the motor and the outer face of the face plate faces away from the side of the motor, and the bracket of the face plate is releasably attached to the blade iron so as to be separable from the blade iron; and an engagement element formed in the brace mates with a complemental engagement element formed in the second end marginal edge of the face plate so as to connect the brace with respect to the second end marginal edge of the face plate.

2. The ceiling fan according to claim 1, wherein the bracket is located near the first end marginal edge between the first and second end marginal edges.

3. The ceiling fan according to claim 2, wherein the blade iron is located between the first and second end marginal edges.

4. The ceiling fan according to claim 1, further comprising:

the second end marginal edge has a length that extends from the first side marginal edge to the second side marginal edge; and the complemental engagement element extends along the length of the second end marginal edge from the first side marginal edge to the second side marginal edge.

5. The ceiling fan according to claim 4, wherein the complemental engagement element is unbroken.

6. The ceiling fan according to claim 5, wherein the engagement element is received by, and extends along the length of, the complemental engagement element from the first side marginal edge to the second side marginal edge.

7. The ceiling fan according to claim 6, wherein the engagement element comprises one of a tongue and a groove, and the complemental engagement element comprises the other one of the tongue and the groove.

8. The ceiling fan according to claim 1, further comprising the engagement element of the brace and the complemental engagement element of the face plate concurrently contact a vibration dampener applied between the engagement element and the complemental engagement element to dampen vibration between the brace and the fan blade, wherein the vibration dampener comprises a soft, flexible material.

9. A ceiling fan suspended by a down rod, the ceiling fan comprising:

a motor that rotates relative to the down rod, the motor includes a top, an opposed bottom, and a side extending between the top and the opposed bottom;

a brace releasably attached to the top of the motor so as to be separable from the top of the motor;

a blade iron releasably attached to the bottom of the motor opposite to the brace so as to be separable from the bottom of the motor;

a fan blade, the fan blade comprises a face plate including opposed first and second side marginal edges extending between opposed upper and lower end marginal edges, opposed inner and outer faces that extend between the opposed first and second side marginal edges and the opposed upper and lower end marginal edges, and a bracket formed in the inner face of the face plate;

the face plate extends upright along the side of the motor from the lower end marginal edge near the bottom of the motor to the upper end marginal edge near the top of the motor, the inner face of the face plate faces the side of the motor and the outer face of the face plate faces away from the side of the motor, and the bracket of the face plate is releasably attached to the blade iron so as to be separable from the blade iron; and an engagement element formed in the brace mates with a complemental engagement element formed in the upper end marginal edge of the face plate so as to connect the brace with respect to the upper end marginal edge of the face plate.

10. The ceiling fan according to claim 9, wherein the bracket is located near the lower end marginal edge between the upper and lower end marginal edges.

11. The ceiling fan according to claim 10, wherein the blade iron is located between the upper and lower end marginal edges.

12. The ceiling fan according to claim 9, further comprising:

the upper end marginal edge has a length that extends from the first side marginal edge to the second side marginal edge; and the complemental engagement element extends along the length of the upper end marginal edge from the first side marginal edge to the second side marginal edge.

13. The ceiling fan according to claim 12, wherein the complemental engagement element is unbroken.

14. The ceiling fan according to claim 13, wherein the engagement element is received by, and extends along the length of, the complemental engagement element from the first side marginal edge to the second side marginal edge.

15. The ceiling fan according to claim 14, wherein the engagement element comprises one of a tongue and a groove, and the complemental engagement element comprises the other one of the tongue and the groove.

16. The ceiling fan according to claim 9, further comprising the engagement element of the brace and the complemental engagement element of the face plate concurrently contact a vibration dampener applied between the engagement element and the complemental engagement element to dampen vibration between the brace and the fan blade, wherein the vibration dampener comprises a soft, flexible material.

17. A ceiling fan suspended by a down rod, the ceiling fan comprising:

a motor that rotates relative to the down rod about an axis of rotation, the motor includes a top, an opposed bottom, and a side extending between the top and the opposed bottom;

a continuous, annular brace encircles the axis of rotation and is releasably attached to the top of the motor so as to be separable from the top of the motor, and the brace extends radially outward with respect to the axis of rotation and terminates with a marginal perimeter edge located outboard of the side of the motor;

a blade iron releasably attached to the bottom of the motor opposite to the brace so as to be separable from the bottom of the motor;

a fan blade, the fan blade comprises a face plate including opposed first and second side marginal edges extending between opposed upper and lower end marginal edges, opposed inner and outer faces that extend between the opposed first and second side marginal edges and the opposed upper and lower end marginal edges, and a bracket formed in the inner face of the face plate;

the face plate extends upright along the side of the motor from the lower end marginal edge near the bottom of the motor to the upper end marginal edge near the top of the motor, the inner face of the face plate faces the side of the motor and the outer face of the face plate faces away from the side of the motor, and the bracket of the face plate is releasably attached to the blade iron so as to be separable from the blade iron; and an engagement element formed in the marginal perimeter edge of the brace mates with a complemental engagement element formed in the upper end marginal edge of the face plate so as to connect the brace with respect to the upper end marginal edge of the face plate.

18. The ceiling fan according to claim 17, wherein the bracket is located near the lower end marginal edge between the upper and lower end marginal edges.

19. The ceiling fan according to claim 18, wherein the blade iron is located between the upper and lower end marginal edges.

20. The ceiling fan according to claim 17, further comprising:

the upper end marginal edge has a length that extends from the first side marginal edge to the second side marginal edge; and the complemental engagement element extends along the length of the upper end marginal edge from the first side marginal edge to the second side marginal edge.

21. The ceiling fan according to claim 20, wherein the complemental engagement element is unbroken.

22. The ceiling fan according to claim 21, wherein the engagement element formed in the perimeter marginal edge of the brace is received by, and extends along the length of, the complemental engagement element from the first side marginal edge to the second side marginal edge.

23. The ceiling fan according to claim 22, wherein the engagement element comprises one of a tongue and a groove, and the complemental engagement element comprises the other one of the tongue and the groove.

24. The ceiling fan according to claim 17, further comprising the engagement element of the brace and the complemental engagement element of the face plate concurrently contact a vibration dampener applied between the engagement element and the complemental engagement element to dampen vibration between the brace and the fan blade, wherein the vibration dampener comprises a soft, flexible material.

* * * * *